United States Patent [19]

Steinhauer

[11] 4,071,463

[45] Jan. 31, 1978

[54] STABLE CLEANING AGENTS OF HYPOCHLORITE BLEACH AND DETERGENT

[75] Inventor: Alfred F. Steinhauer, Midland, Mich.

[73] Assignee: The Dow Chemical Company, Midland, Mich.

[21] Appl. No.: 689,271

[22] Filed: May 24, 1976

Related U.S. Application Data

[63] Continuation-in-part of Ser. No. 612,414, Sept. 11, 1975, abandoned.

[51] Int. Cl.[2] ..... C11D 7/54

[52] U.S. Cl. ..... 252/103; 252/95; 252/99; 252/549; 252/550; 252/554; 252/558; 8/108 A

[58] Field of Search ..... 252/99, 95, 103, 549, 252/554, 558, 550; 8/108

[56] References Cited

U.S. PATENT DOCUMENTS

| | | | |
|---|---|---|---|
| 3,172,861 | 3/1965 | Steinhauer et al. | 252/95 X |
| 3,558,496 | 1/1971 | Zmoda | 252/95 |
| 3,560,389 | 2/1971 | Hunting | 252/95 |
| 3,728,266 | 4/1973 | Komeda et al. | 252/99 X |
| 3,758,409 | 9/1973 | Nakagawa et al. | 252/99 |
| 3,929,661 | 12/1975 | Nakagawa et al. | 252/99 X |

*Primary Examiner*—Mayer Weinblatt
*Attorney, Agent, or Firm*—Albin R. Lindstrom

[57] ABSTRACT

A cleaning formulation for cleaning stubborn stains comprises an aqueous solution of (a) an alkali metal alkyl sulfate wherein the alkyl is a straight chain of from about 6 to 20 carbon atoms, (b) an alkylated diphenyl oxide sulfonic acid alkali metal salt, such as sodium dodecyl diphenyl oxide disulfonate, (c) a branched chain alkyl aryl sulfonate wherein the alkyl group contains from 8 to 18 carbon atoms or (d) mixtures thereof as a detergent with less than one weight percent of sodium hypochlorite and with an amount of an alkaline builder to maintain the pH above about 11.0.

8 Claims, No Drawings

STABLE CLEANING AGENTS OF HYPOCHLORITE BLEACH AND DETERGENT

REFERENCE TO RELATED APPLICATION

This application is a continuation-in-part of my copending application U.S. Ser. No. 612,414 filed Sept. 11, 1975 now abandoned.

BACKGROUND OF THE INVENTION

The removal of stubborn stains, such as fruit juices, tea, coffee and ink, from counter tops and like surfaces is a particularly vexatious problem. Frequently, such stains are found in the same area and are caused at the same time as grease and oil spatters and spills such as may occur on range tops during meal preparation. A variety of aqueous detergent compositions are available for cleaning the grease and oil, but are ineffective against stains on the counter tops which are usually a thermoset plastic laminate. Powdered abrasive bleach products are available to remove those stains but unless great care is exercised, they will destroy the gloss finish on painted and porcelainized appliances and the plastic counter top.

Sodium hypochlorite has been used as a bleaching agent for decades. However, it has no detergency. Also the same properties that cause it to be effective against organic stains from aqueous solution have precluded its combination with organic detergents as an aqueous cleaning preparation. In the past, sodium hypochlorite has been combined in solution with inorganic detergents, such as trisodium phosphate, or has been combined with organic detergents as a dry granular powder which is dissolved in water just prior to use.

THE PRIOR ART

U.S. Pat. No. 1,522,561 was an early recognition of the stability problem of hypochlorite bleaches in the presence of other materials in aqueous solution.

In U.S. Pat. No. 1,894,207, the hypochlorite instability is expressly noted and overcome with a composition of an inorganic detergent and hypochlorite.

In U.S. Pat. No. 1,937,229, the corrosivity of hypochlorite-caustic solutions is minimized by incorporating an alkali metal silicate therein.

The solution to the stability problem by blending solid materials which are dissolved just before or during use is shown in U.S. Pat. Nos. 1,988,991; 2,034,361 and 3,498,924.

Stable aqueous hypochlorite solutions containing potassium dichromate are disclosed in U.S. Pat. No. 2,662,858.

Solid compositions of organic detergents, hypochlorite, and various other ingredients are taught in U.S. Pat. Nos. 2,524,394; 3,008,903; 3,042,621; 3,518,201; 3,630,923; 3,640,878 and 3,763,047.

U.S. Pat. No. 3,172,861 teaches a foaming bleaching solution of hypochlorite and from 1 to 100 percent thereof of an alkali metal sulfonate. In that concept, there is always an excess of bleaching agent present.

DESCRIPTION OF THE INVENTION

A stable aqueous cleaning formulation exhibiting both bleaching and detergency properties results from an aqueous solution of (1) (a) an alkali metal alkyl sulfate as further defined, (b) an alkylated diphenyl oxide sulfonic acid alkali metal salt, (c) a branched chain alkyl aryl sulfonate wherein the alkyl group contains from 8 to 18 carbon atoms, or (d) mixtures thereof, (2) less than one weight percent of the formulation of sodium hypochlorite and (3) an amount of an alkaline builder to maintain the pH of the aqueous formulation above about 11.0.

The above named classes of synthetic detergents provide stable aqueous solutions with sodium hypochlorite. One of the useful classes is the group of alkali metal alkyl sulfates wherein the alkyl group is at least predominantly a straight chain of from about 6 to about 20 carbon atoms. The length of the chain is generally limited to the stated size by detergency characteristics. Formulations of alkali metal alkyl sulfates having straight chain alkyl groups exhibit substantially improved hypochlorite stability in the aqueous solution over such sulfates having branched chain alkyl groups. The preferred species providing optimum overall properties to the formulations is sodium lauryl sulfate.

The alkylated diphenyl oxide sulfonic acid alkali metal salts and their nuclearly mono and dichlorinated derivatives, suitable for use in accordance with the present invention are those having from 8 to 22 carbon atoms in the alkyl chain and an average of from 1.8 to 2.3 sulfonate moities per diphenyl oxide moiety. Sodium dodecyl diphenyl oxide disulfonate is preferred.

The third class of detergents useful herein are the alkyl aryl sulfonates wherein the alkyl group is a branched chain having from about 8 to 18 carbon atoms. Solutions made with the isomers having linear unbranched alkyl groups do not exhibit the hypochlorite stability that results when the branched chain isomers are used. A typical branched chain sulfonate is a highly branched dodecyl benzene sodium sulfonate sold commercially as Siponate DS-10.

The bleaching agent is an alkali metal hypochlorite. Sodium hypochlorite is preferred.

If maximum hypochlorite stability is to be attained, the formulations should be at a high pH, preferably of from about 11.0 to 13.0. That is easily achieved by including a water soluble alkaline builder into the composition. Preferred alkaline builders are the inorganic salts, such as the alkali metal carbonates (e.g. sodium carbonate), the alkali metal phosphates (e.g. trisodium phosphate, and the alkali metal silicates (e.g. sodium metasilicate). Any suitable base, such as sodium and potassium hydroxide may also be employed. Combinations of salts and bases may be used.

The amounts of the ingredients are chosen to give the desired levels of detergency, bleaching and stability. Those amounts may be varied within generally wide limits as hereinafter qualified. The amount of active cleaning, bleaching and stabilizing ingredients will usually not exceed about 10 weight percent of the solution and preferably will be in the range of about 1 to 5 weight percent for a general household cleaning formulation. In that instance, the detergent will be in a concentration of from about 0.5 to 3 weight percent, the hypochlorite in the range of from about 0.25 to 1.0 weight percent and the alkaline builder in an amount sufficient to raise the pH to 11.0 or above.

The basic guidelines for preparing the compositions are that the detergent be present in excess over the hypochlorite and that the hypochlorite bleaching agent not exceed about 1.0 weight percent of the solution. Thus it will be apparent that the detergent may be present in a concentration of from about 0.5 up to its limit of solubility while retaining a fluid state.

Other ingredients may be added to the solutions for desired special purposes. For example, inorganic thickening agents may be included to enhance the utility of the cleaner on vertical surfaces. Typical of such colloids are the inorganic clays, such as Macoloid clay. Such materials are readily available. One preferred thickener is a synthetic clay containing hydrated sodium magnesium silicates sold commercially as Laponite 2501. Organic colloids are generally not useful since they tend to destabilize the bleach.

Minor amounts of, for example, up to about 1 weight percent of the formulation, of bleach stable organic solvents may also be included to enhance the cleaning effectiveness of the composition. By bleach stable is meant that the solvent does not react with or otherwise adversely affect the stability of the hypochlorite. Thus, solvents, such as alcohols, ketones, and alkanolamines will be inopposite. Petroleum distillates, such as kerosene and naphtha, are typical of useful solvents.

Additives, such as the above-described thickeners and solvents, will frequently be insoluble in water with the result that the cleaning formulation will be a dispersion of the additive in the water. So long as the additives are uniformly dispersed, they will not adversely affect the results obtained.

Fragrances may also be included in the formulations for their intended purpose. It is necessary that any such fragrance be stable to the bleach. That can be determined by simple preliminary experiment.

EXAMPLE 1

Formulations were prepared containing 0.75 weight percent sodium hypochlorite, 2.8 weight percent trisodium phosphate and 1.5 weight percent active surfactant with 94.95 weight percent deionized water.

Separate samples of each formulation were aged at three temperatures. The hypochlorite concentration was determined by titrating the free iodine released from KI with sodium thiosulfate. The rate at which the bleach disappeared was used to extrapolate the number of days when half of the bleach was used up — the half-life — which is temperature dependent.

The results are shown in the following table.

TABLE I

| Surfactant Trade Name | Description | Bleach Half-Life DAYS 69–73° F | DAYS 90° F | DAYS 120° F |
|---|---|---|---|---|
| THIS INVENTION | | | | |
| Stepanol WA-100 | Sodium Lauryl Sulfate | 2253 | 326 | 60 |
| Dowfax 2A1 | Sodium Dodecyl Diphenyl Oxide Sulfonate | | | 58 |
| FOR COMPARISON | | | | |
| Triton X-100 | Octylphenoxy Polyethoxy Ethanol | 128 | 62 | 9 |
| Igepal CO 730 | Nonylphenoxy poly (ethyleneoxy) Ethanol | 94 | 79 | 17 |
| Biosoft EA 10 | Ethoxylated Fatty Alcohol | 20 | | |
| Brij 56 | Polyoxyethylene (10) cetyl ether | 29 | | 3 |
| Neodol 25-9 | $C_{12}$–$C_{15}$ Linear primary alcohol ethoxylate | 41 | | |
| Renex | Ethoxylated nonyl phenol | 68 | | |
| Makon 10 | Alkylphenoxy polyoxyethylene ethanol | 32 | | |
| Steol CS 460 | Coconut ether sulfate, sodium salt | 54 | | |
| Sipon ESY | Sodium Lauryl Ether Sulfate | 419 | | 20 |
| Sipex TDS | Sodium Tridecyl Sulfate | 399 | | 23 |
| Sulframin 45 | Linear Alkylaryl Sodium Sulfonate | 60 | | 11 |
| Calsoft L-40 | Linear Alkylaryl Sodium Sulfonate | 133 | | |
| Igepon TC-42 | Sodium N-coconut Acid N-methyl Taurate | 17 | | 2 |
| Ninol AA 62 Extra | Fatty Acid Alkanolamide | 0 | | |
| Potassium Coconut Soap | | 52 | | |
| Alipal CO 433 | Sodium Salt of a Sulfate Ester of a Alkylphenoxy Poly (ethylene oxyl) ethanol | 94 | | |
| Miranol SM Conc. | Amphoteric Surfactant | 0 | | |
| Ammonyx LO | Lauryl Dimethylamine Oxide | 120 | | |
| Bioterge AS-90F | Alphaolefin Sulfonate | 78 | | |

As a comparison, an aqueous solution of 0.75 weight sodium hypochlorite had a half-life at 120° F of 253 days and a 5 weight percent sodium hypochlorite solution had a half-life at 120° F of 40 days.

EXAMPLE 2

Aqueous solutions of 1.5 weight percent sodium lauryl sulfate with 0.57 weight percent sodium hydrochlorite (containing about 0.04 percent sodium hydroxide) and various alkaline builders were prepared and tested for half-life as in Example 1. The results are shown in the following Table II.

TABLE II

| Builder | % Conc | DAYS 69–73° F | DAYS 90° F | DAYS 120° F |
|---|---|---|---|---|
| None | | 312 | 86 | 15 |
| Trisodium Phosphate | 2.8 | 1432 | 469 | 58 |
| Sodium Carbonate | 2.0 | | 139 | 28 |
| Sodium Metasilicate | 1.0 | 2382 | 628 | 91 |
| Sodium Hydroxide | .32 | | | 85 |
| Sodium Hydroxide | .41 | | | 103 |
| Sodium Hydroxide | .46 | | | 114 |

EXAMPLE 3

The following comparison was made to show the influence of the alkaline builder on the stability of the composition.

A composition of 1.5 weight percent sodium dodecyl diphenyl oxide sulfonate, 0.57 weight percent sodium hypochlorite and 97.93 weight percent water was prepared. When tested according to the previous examples, it had a half-life of 15 days at 120° F.

A similar composition containing the same amounts of surfactant and sodium hypochlorite but containing 0.32 weight percent sodium hydroxide and 97.61 weight percent water had a half-life of 132 days at 120° F.

EXAMPLE 4

The strong influence of the alkaline builder on the stability of the detergent compositions was also determined using different emulsifiers with and without the builder. The results are shown in the following table.

TABLE III

| Trade Name | % | Description | Bleach Half-Life: Percent sodium hydroxide | Bleach Half-Life: Days 120° F |
|---|---|---|---|---|
| Proctor & Gamble Emulsifier 104 | 0.5 | Sodium lauryl sulfate | 0.3 | 220 |
| Proctor & Gamble Emulsifier 104 | 0.5 | Sodium lauryl sulfate | 0.0 | 4 |
| Dowfax 2A1 | 0.5 | Sodium dodecyl diphenyl oxide disulfonate (branched chain) | 0.3 | 216 |
| Dowfax 2A1 | 0.5 | Sodium dodecyl diphenyl oxide disulfonate (branched chain) | 0.0 | 3 |
| Siponate DS-10 | 1 | Dodecyl benzene sodium sulfonate (branched chain) | 0.3 | 264 |
| Siponate DS-10 | 1 | Dodecyl benzene sodium sulfonate (branched chain) | 0.0 | 4 |
| Triton X-100 | 1 | Octylphenoxy polyethoxy ethanol | 0.3 | 27 |
| Triton X-100 | 1 | Octylphenoxy polyethoxy ethanol | 0.0 | less than 1 |

EXAMPLE 5

Thickened formulations were prepared from 1.5 weight percent sodium lauryl sulfate sold commercially as Procter and Gamble Emulsifier 104, 0.32 weight percent sodium hydroxide, 0.57 weight percent sodium hypochlorite, 2.0 weight percent Laponite 2501, a synthetic clay containing hydrated sodium magnesium silicates, and 95.61 weight percent water.

A similar composition was prepared from 3.0 weight percent Macaloid Clay, 94.61 weight percent water and all other ingredients in the same amounts.

The compositions were stable and showed outstanding cleaning efficiency.

EXAMPLE 6

A composition having reduced aluminum corrosion was prepared similar to the first formulation of Example 5 except it contained 0.12 weight percent sodium hydroxide, 0.58 weight percent sodium metasilicate, 0.55 weight percent sodium hypochlorite and 95.25 weight percent water.

EXAMPLE 7

Detergent formulations were prepared using different detergents. In all cases the formulations contained 0.5 weight percent sodium hypochlorite, 0.3 weight percent sodium hydroxide and 1 weight percent active surfactant. The results are shown in the following table.

TABLE IV

| Trade Name | Description | Bleach Half-Life: Days 90°F | Bleach Half-Life: Days 120°F |
|---|---|---|---|
| THIS INVENTION | | | |
| Siponate DS-10 | Dodecyl benzene sodium sulfonate (highly branched chain) | 1964 | 264 |
| Conc AAS-35H | Dodecyl benzene sodium sulfonate (highly branched chain) | | 94 |
| Dowfax 3B2 | Sodium n-decyl diphenyloxide disulfonate | | 86 |
| FOR COMPARISON | | | |
| Nacconol 90F | Linear alkylaryl sodium sulfonate | 26 | 8 |
| Calsoft L-40 | Linear alkylaryl sodium sulfonate | | 7 |
| Steol 7N | Linear fatty alcohol ether sulfate | | 7 |
| Triton X-100 | Octylphenoxy polyethoxy ethanol | | 27 |

What is claimed is:

1. A liquid cleaning formulation consisting essentially of an aqueous solution of (1) from 0.5 weight percent up to its limit of aqueous solubility of a synthetic detergent selected from the group consisting of (a) a water soluble alkali metal alkyl sulfate wherein said alkyl group is a straight chain moiety containing from about 6 to 20 carbon atoms, or (b) a water soluble branched chain alkyl aryl sulfonate wherein the alkyl group contains from 8 to 18 carbon atoms, or (c) water soluble mixtures thereof, (2) not more than one weight percent of said formulation of sodium hypochlorite and (3) a sufficient amount of a water soluble alkaline builder to maintain the pH of said formulation at above about 11.0 and wherein said detergent is present in excess over the hypochlorite.

2. The cleaning formulation of claim 1 wherein said synthetic detergent is sodium lauryl sulfate.

3. The cleaning formulation of claim 1 wherein said alkaline builder is sodium hydroxide.

4. The cleaning formulation of claim 1 wherein said alkaline builder is trisodium phosphate.

5. The cleaning formulation of claim 1 wherein said alkaline builder is sodium metasilicate.

6. The cleaning formulation of claim 1 consisting essentially of at least 95 weight percent water, from about 0.5 to 3 weight percent synthetic detergent, from about 0.25 to 1 weight percent sodium hypochlorite, and sufficient alkaline builder to establish the pH of said formulation at from about 11.0 to 13.0.

7. The cleaning formulation of claim 1 containing in addition a thickening amount of an inorganic thickener.

8. The cleaning formulation of claim 7 wherein said inorganic thickener is a water swellable clay.

* * * * *